US007171945B2

(12) United States Patent
Matsuda et al.

(10) Patent No.: US 7,171,945 B2
(45) Date of Patent: Feb. 6, 2007

(54) THROTTLE DEVICE FOR MULTIPURPOSE ENGINE

(75) Inventors: Hayato Matsuda, Wako (JP); Tomoki Fukushima, Wako (JP); Takao Tamechika, Wako (JP); Shinichi Katsuragawa, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 11/234,150

(22) Filed: Sep. 26, 2005

(65) Prior Publication Data

US 2006/0112930 A1 Jun. 1, 2006

(30) Foreign Application Priority Data

Sep. 28, 2004 (JP) ..... 2004-282371

(51) Int. Cl.
*F02D 11/10* (2006.01)

(52) U.S. Cl. ..... 123/399; 123/361

(58) Field of Classification Search ..... 123/361, 123/399

See application file for complete search history.

(56) References Cited

U.S. PATENT DOCUMENTS 6,725,833 B1 * 4/2004 Irihune et al. ..... 123/399
6,854,443 B2 * 2/2005 Keefover et al. ..... 213/399
6,892,699 B2 * 5/2005 Urushiwara ..... 123/399
7,007,666 B2 * 3/2006 Kamimura et al. ..... 123/399
7,032,569 B2 * 4/2006 Ikeda et al. ..... 123/399

FOREIGN PATENT DOCUMENTS

DE 004129844 A1 * 3/1993
EP 000596392 A1 * 5/1994
JP 05-231894 9/1993

* cited by examiner

*Primary Examiner*—T. M. Argenbright
(74) *Attorney, Agent, or Firm*—Westerman, Hattori, Daniels & Adrian, LLP.

(57) ABSTRACT

In a multipurpose engine throttle device having a throttle body disposed at an intake pipe of the engine and housing a throttle valve, a case is integrally attached to the throttle body and housing an electric motor moving the throttle valve, a speed reducer connecting an output shaft of the motor with the throttle valve, an electronic circuit board having an electronic control unit that controls operation of the motor and a connector mounted thereon, and a harness connecting the motor with the connector, thereby reducing in overall size by efficient layout of these components.

3 Claims, 3 Drawing Sheets

THROTTLE DEVICE FOR MULTIPURPOSE ENGINE

BACKGROUND OF THE INVENTION

1. Field of the Invention

This invention relates to a throttle device for a multipurpose engine, particularly to a throttle device for a multipurpose engine having an electric motor to open and close a throttle valve.

2. Description of the Related Art

The multipurpose engines used as prime movers in generators, agriculture machinery and various other applications have generally used a throttle device constituted as a mechanical governor. Specifically, engine speed is regulated by using a mechanical governor composed of weights and a spring to open and close a throttle valve housed in a throttle body.

While not relating to a multipurpose engine, Japanese Laid-Open Patent Application No. Hei 5(1993)-231894 (paragraphs 0012, 0013 and elsewhere), teaches a throttle device for an automobile engine, which improves the device in terms of structural simplicity, compactness and mountability by attaching an airflow sensor, throttle position sensor and control unit directly to the throttle body and enclosing them with a cover.

Attempts to improve fuel efficiency and reduce emissions have extended to the multipurpose engine in recent years. This led to the development of technologies for improving the accuracy of air intake regulation by using an electronically controlled throttle device (i.e., electronic governor) for opening and closing the throttle valve using an electric motor.

When a throttle valve is driven by an electric motor, the drive torque applied to the throttle valve needs to be increased and the step angle (minimum a rotation angle) needs to be decreased. This requires use of a speed reducer for gearing down the output of the motor before transmitting it to the throttle valve. A circuit board having an electronic control unit for controlling the operation of the motor, a harness for interconnecting the circuit board and the motor, and the like also become necessary.

As pointed out above, multipurpose engines are used to drive various kinds of equipment and when the engine is built into a machine it is subject to numerous layout restrictions, making it essential to avoid increase in the size of the incorporated components. Use of an electric motor for driving the throttle valve has therefore been disadvantageous because the large number of components required and the relatively large size thereof has tended to increase the overall size of the throttle device.

SUMMARY OF THE INVENTION

An object of this invention is therefore to overcome this drawback by providing a throttle device for a multipurpose engine reduced in overall size by efficient layout of the plurality of components required for opening and closing the throttle valve, such as an electric motor, reduction gearing and electronic circuit board.

In order to achieve the object, this invention provides a throttle device for a multipurpose engine, comprising: a throttle body disposed at an intake pipe of the engine and housing a throttle valve that regulates air drawn in the intake pipe; and a case integrally attached to the throttle body and housing an electric motor moving the throttle valve, a speed reducer connecting an output shaft of the motor with a throttle shaft of the throttle valve, an electronic circuit board having an electronic control unit that controls operation of the motor and a connector mounted thereon, and a harness connecting the motor with the connector.

BRIEF DESCRIPTION OF THE DRAWINGS

The above and other objects and advantages of the invention will be more apparent from the following description and drawings in which.

DETAILED DESCRIPTION OF THE PREFERRED EMBODIMENT

An Embodiment of a throttle device for a multipurpose engine according to the present invention will now be explained with reference to the attached drawings.

Figure 1:
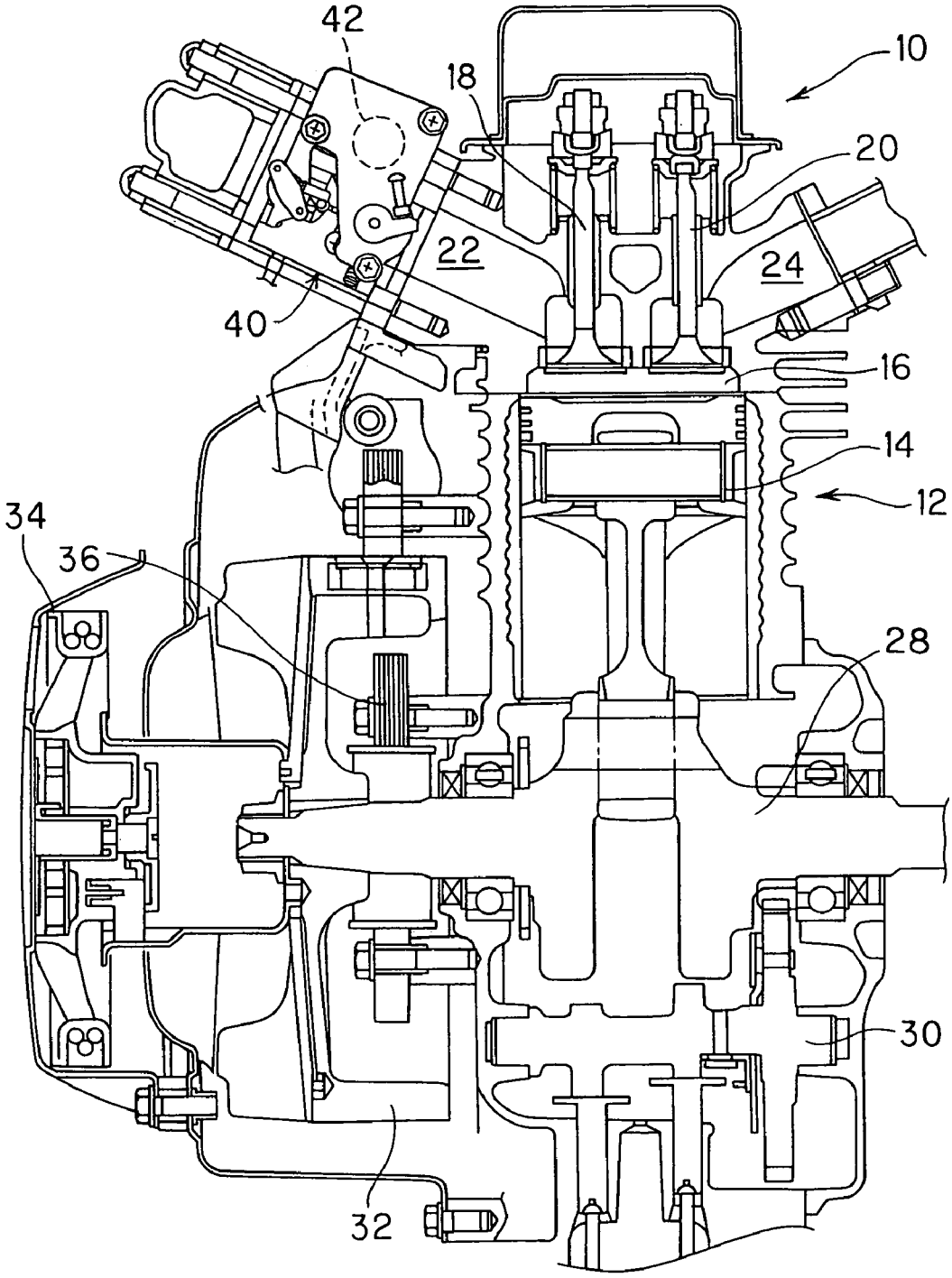
FIG. 1 is a schematic view showing the entire configuration of a throttle device for a multipurpose engine according to an embodiment of the present invention.

FIG. 1 is a schematic view showing the entire configuration of a throttle device for a multipurpose engine according to an embodiment of the present invention.

Reference numeral 10 in FIG. 1 indicates a multipurpose or general-purpose engine (hereinafter referred to as "engine"). The engine 10 is provided with one cylinder 12, and a piston 14 is contained therein so as to be able to reciprocate. An intake valve 18 and an exhaust valve 20 that are both located to face a combustion chamber 16 to open and close between the fuel combustion chamber 16 and an air intake pipe 22 or exhaust pipe 24. The engine 10 specifically comprises a water-cooled four-cycle single cylinder OHV-type internal combustion engine that is provided with a volume displacement of 196 cc.

The piston 14 is connected to a crankshaft 28, and the crankshaft 28 is connected to a camshaft 30 via a gear. A flywheel 32 is attached to the crankshaft 28, and a recoil starter 34 for allowing an operator to manually start the engine 10 is also attached at the leading end of the flywheel 32. A generating coil (i.e., alternator) 36 is disposed on the inside of the flywheel 32 and generates an alternating electrical current. The alternating current generated by the generating coil 36 is converted to a direct current via a processing circuit (not shown), and is then supplied as the source of operating power to an ignition circuit (not shown), an electronic circuit board described hereinafter and other components.

A throttle body 40 is disposed at the intake pipe 22. Although not illustrated in FIG. 1, a throttle valve is housed in the throttle body 40 and is connected to an electric motor 42 via a throttle shaft and speed reducer described hereinafter. An air cleaner (not shown) is disposed at the intake pipe 22 in the vicinity of the throttle body 40, more specifically at a position upstream from the throttle body 40, and removes dust existing in the intake air.

A carburetor assembly (not shown in FIG. 1) is also provided to the throttle body 40. The carburetor assembly is connected to a fuel tank (not shown) and injects gasoline fuel into air drawn regulated by the throttle valve to generate an air-fuel mixture. The air-fuel mixture thus generated is drawn in to the fuel combustion chamber 16 of the cylinder 12 through the intake pipe 22 and intake valve 18.

Thus, the multipurpose engine 10 according to this embodiment has the throttle device (electronic governor) that is electronically controlled to open and close, i.e., to move the throttle valve using the electric motor 42, and its engine speed is therefore regulated by the throttle device.

Figure 2:
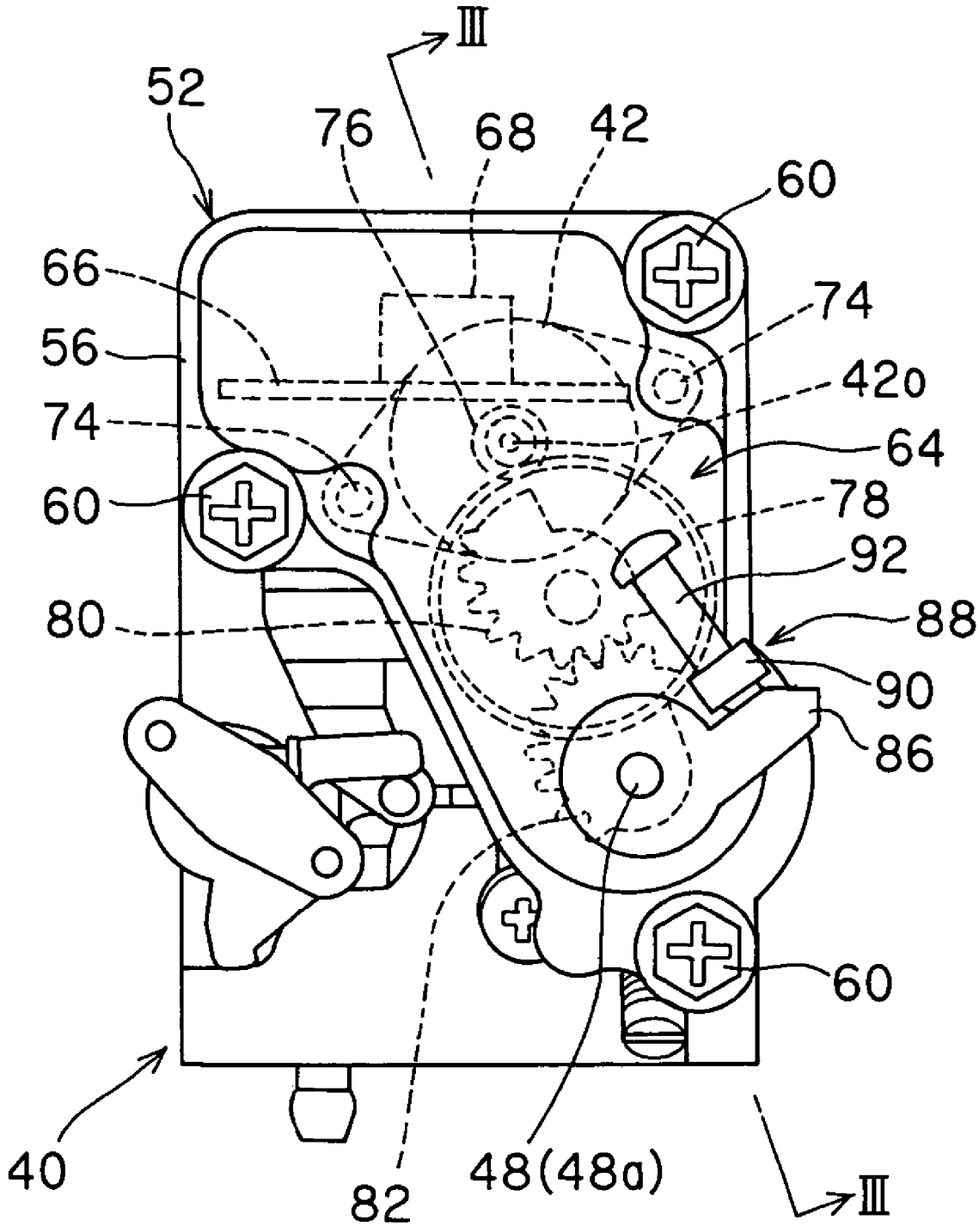
FIG. 2 is an enlarged plan view of a throttle body illustrated in FIG. 1.

The throttle body 40 will now be explained in detail with reference to FIGS. 2 and 3. FIG. 2 is an enlarged plan view of the throttle body 40 and FIG. 3 is a partial sectional view taken along line III—III in FIG. 2.

Figure 3:
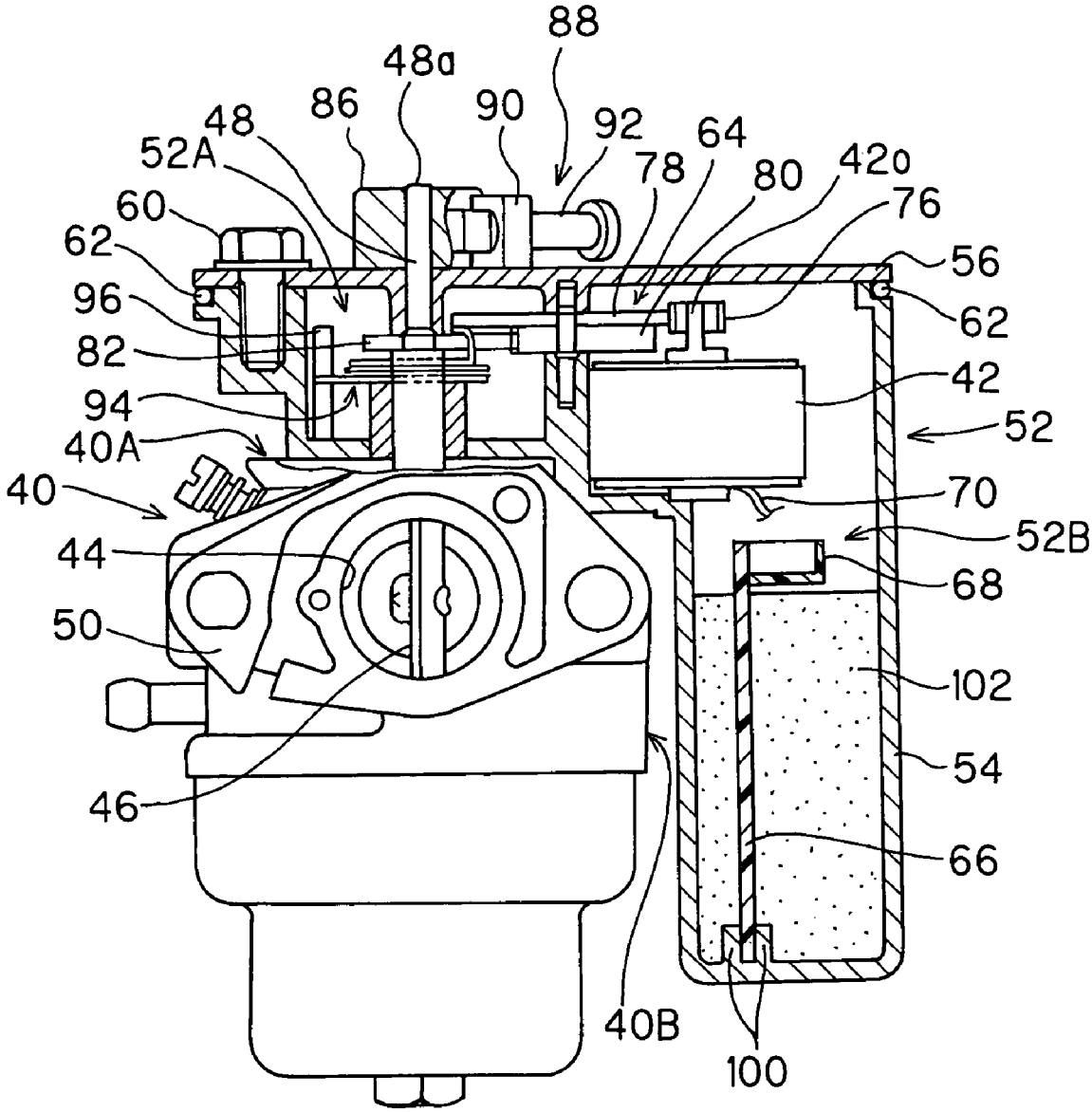
FIG. 3 is a partial sectional view taken along line III—III in FIG. 2.

As shown in FIG. 3, the throttle valve (now assigned with reference numeral 46) is installed in an air intake passage 44 formed in the throttle body 40. The throttle valve 46 is rotatably supported on the throttle body 40 through a throttle shaft (rotary shaft) 48. The carburetor assembly (now assigned with reference numeral 50) is mounted on the upstream side of the throttle valve 46 installed in the air intake passage 44 formed in the throttle body 40.

As shown in FIGS. 2 and 3, a case 52 is integrally attached to the throttle body 40. The case 52 includes a case body 54 and a cover 56.

As shown in FIG. 3, the case 52, more specifically the case body 54 thereof is bent along the shape of the throttle body 40, more exactly along the shape of the throttle body 40 and the carburetor assembly 50 mounted thereon.

Specifically, the case 52 is formed in an L-like shape so as to cover a plurality of (two in this embodiment) outer faces of the throttle body 40 and carburetor assembly 50, namely, the face from which the throttle shaft 48 projects (face lying perpendicular to the axial direction of the throttle shaft 48; designated 40A) and the face corresponding to the side surface of the throttle body 40 and carburetor assembly 50 when the face 40A is defined as the upper face (face lying parallel to the axial direction of the throttle shaft 48; designated 40B). In the following, the space inside the case 52 enclosing the face 40A will sometimes be called the first space (designated 52A). The space enclosing the face 40B (space lying perpendicular to the first space 52A) will sometimes be called the second space (designated 52B).

The wall of the case body 54 confronting the face 40A of the throttle body is intimately attached to the face 40A, thereby integrating the case 52 and throttle body 40. The face of the case body 54 confronting the wall attached to the throttle body 40 is opened and the cover 56 is attached to close it. The case body 54 and cover 56 are fastened together by three bolts 60 (shown in FIG. 2) with a rubber packing (sealing material) 62 interposed therebetween. This makes the case 52 waterproof and dustproof.

The case 52 houses the electric motor (stepper motor) 42, a speed reducer (specifically reduction gearing) 64 that connects an output shaft 42*o* of the motor 42 with the throttle shaft 48, an electronic circuit board 66 on which an electronic control unit that controls the operation of the motor 42 is mounted, and a harness 70 (shown partially) that connects the motor 42 with a connector 68 provided on the electronic circuit board 66.

The layout of the components housed in the case 52 will be explained in further detail.

As shown in FIG. 3, the throttle shaft 48 is inserted through the first space 52A of the case 52. The motor 42 is installed at the region where the case 52 bends (region where the first space 52A and second space 52B meet at right angles). The motor 42 is fastened to the case body 54 by two bolts 74 (shown in FIG. 2) in such orientation that its output shaft 42*o* lies parallel to the throttle shaft 48.

The speed reducer 64 is installed in the first space 52A of the case 52. As shown in FIGS. 2 and 3, the speed reducer 64 is composed of four gears. It transmits the output of the motor 42 to the throttle shaft 48 at reduced speed and increased torque. Specifically, a first gear 76 is attached to the motor output shaft 42*o* and engaged with a second gear 78 rotatably supported in the first space 52A. A third gear 80 is attached to coaxially with the second gear 78 and engaged with a fourth gear 82 attached to the throttle shaft 48. The output of the motor 42 is reduced in speed in accordance with the gear ratios and transmitted to the throttle shaft 48 to change the degree of opening of the throttle valve 46.

As clearly illustrated in FIG. 2, the third gear 80 and fourth gear 82 are eccentric gears. The eccentric third gear 80 and fourth gear 82 are configured so that the rotation angle of the fourth gear 82 per unit rotation angle of the third gear 80 decreases (i.e., the speed reduction ratio increases) with decreasing opening of the throttle valve 46. This configuration is adopted in consideration of the fact that the pressure difference between the upstream and downstream sides of the throttle valve 46 decreases with increasing throttle opening and finally reaches a minimum value (i.e., the amount of change in the rate of flow of intake air through the throttle valve 46 per unit change in the throttle opening increases with decreasing throttle opening). This configuration of the third gear 80 and fourth gear 82 enables the throttle opening to be precisely regulated when the throttle opening is small and the throttle opening to be more rapidly regulated as the throttle opening increases, whereby the engine speed can be regulated accurately and with good response.

The explanation with reference to FIGS. 2 and 3 will be resumed. One end of the throttle shaft 48 passes through the cover 56 to project outside the case 52. A lever 86 is attached to the portion (designated 48*a*) of the throttle shaft 48 projecting outward from the case 52.

A manually operable idle speed regulator 88 that regulates the idle speed of the engine 10 is provided on the outer surface of the cover 56 near the lever 86. The idle speed regulator 88 is composed of a female screw member 90 that projects from the outer surface of the cover 56 and is centrally formed with an internal (female) screw and a bolt 92 screwed into the female screw.

As shown in FIG. 3, a throttle return spring (torsion coil spring) 94 is fitted around the throttle shaft 48 in the first space 52A. One end of the throttle return spring 94 is fastened to the fourth gear 82 attached to the throttle shaft 48 and the other end thereof is fastened to a hook pin 96 projecting into the first space 52A. The throttle return spring 94 is wound in the direction that enables it to rotate the throttle shaft 48 in the direction of closing the throttle valve 46.

When the throttle shaft 48 is rotated in the direction of closing the throttle valve 46, the lever 86 attached to the throttle shaft 48 rotates toward the tip of the bolt 92. In other words, the lever 86 is brought into contact with the tip of the bolt 92 by the force of the throttle return spring 94, thereby retaining the throttle shaft 48 at a rotated position or angle. The opening of the throttle valve 46 at this time is that when the engine 10 is idling. The idle speed of the engine 10 can therefore be regulated by turning the bolt 92 to change the location of its tip and thereby change the throttle opening during idling.

The electronic circuit board 66 is installed in the second space 52B of the case 52. The electronic circuit board 66 has the electronic control unit comprising a CPU, drive circuit and other electronic components (none of which are shown) mounted thereon and is supplied with operating power from the generating (magneto) coil 36. The electronic circuit board 66 is also equipped with the connector 68 for connection with the motor 42. The motor 42 and the connector 68 are electrically connected through the harness 70. The outputs of a throttle position sensor and other sensors (none of which are shown) installed inside and/or outside the case 52 are supplied to the electronic control unit mounted on the electronic circuit board 66.

Based on the outputs of the throttle position sensor and other sensors, the electronic control unit calculates a current command value for the motor 42 and supplies current as indicated by the calculated current command value to the motor 42 through the drive circuit, connector 68 and harness 70, thereby controlling the operation of the motor 42.

The installation of the electronic circuit board 66 will be explained in greater detail.

As shown in FIG. 3, one end of the electronic circuit board 66 is clamped between two ribs 100 rising from the case body 54 to make the major surfaces of the electronic circuit board 66 parallel to the face 40B. The whole of the electronic circuit board 66 other than the connector 68 is enclosed in injected silicone gel 102 so as to increase resistance to vibration and enhance insulation property. Since, as pointed out above, the case 52 is waterproof and dustproof, no particular measures are taken to waterproof and dustproof the motor 42, connector 68, harness 70 and other individual components housed in the case 52.

As explained in the foregoing, the multipurpose engine throttle device according to this embodiment is equipped with the case 52 that is integrally attached to the throttle body 40 and houses the motor 42 that moves the throttle valve 46, the. speed reducer 64 that connects the output shaft 42*o* of the motor 42 with the throttle shaft 48, the electronic circuit board 66 on which the electronic control unit that controls the operation of the motor 42 is mounted and the harness 70 that connects the motor 42 with the connector 68 provided on the electronic circuit board 66. The plurality of components required for opening and closing the throttle valve 46 can therefore be efficiently laid out around the throttle body 40 (more exactly, around the throttle body 40 and carburetor assembly 50), thereby reducing the overall size of the throttle device.

Moreover, the case 52 is configured to bend along the shape of the throttle body 40 (and carburetor assembly 50), so that the plurality of components required for opening and closing the throttle valve 46 can be still more efficiently laid out around the throttle body 40 (and carburetor assembly 50), thereby further reducing the overall size of the throttle device.

Of particular note is that the case 52 is configured in an L-like shape to form the perpendicularly intersecting first and second spaces 52A, 52B, and the speed reducer 64 to be connected with the motor 42 is installed in the first space 52A, the electronic circuit board 66 to be connected with the motor 42 is installed in the second space 52B, and the motor 42 is installed at the region where the two spaces meet at right angles (at the region where the case 52 bends) to be situated at an intermediate location between the speed reducer 64 and electronic circuit board 66. The motor 42, speed reducer 64 and electronic circuit board 66 can therefore be laid out around the throttle body 40 (and carburetor assembly 50) very efficiently so as to effectively achieve the aforesaid effects.

Moreover, the case 52 is imparted with waterproofing and dustproofing capability. As this makes it unnecessary to waterproof or dustproof the individual components housed in the case 52, the throttle device can be made still more compact in overall size.

This embodiment is thus configured to have a throttle device for a multipurpose engine (10), comprising: a throttle body (40) disposed at an intake pipe (22) of the engine and housing a throttle valve (46) that regulates air drawn in the intake pipe; and a case (52) integrally attached to the throttle body and housing an electric motor (42) moving the throttle valve, a speed reducer (64) connecting an output shaft (42*o*) of the motor with a throttle shaft (48) of the throttle valve, an electronic circuit board (66) having an electronic control unit that controls operation of the motor and a connector (68) mounted thereon, and a harness (70) connecting the motor with the connector.

In the throttle device, the case (52) is configured to bend along a shape of the throttle body (40), specifically, the case (52) is configured in an L-like shape to form a first space (52A) in which the speed reducer (64) is installed and a second space (52B) in which the electronic circuit board (66) is installed.

In the throttle device, the motor (42) is installed at a region where the two spaces meet at right angles to be situated at an intermediate location between the speed reducer (64) and the electronic circuit board (66).

In the throttle device, the case (52) is imparted with waterproofing and dustproofing capability.

It should be noted that, although the motor 42 is described as a stepper motor in the foregoing, it can instead be another type of electric motor, such as a DC motor.

It should also be noted that the case 52 is described as having an L-like shape that covers the two faces 40A, 40B of the throttle body 40. However, it can instead be given a shape that covers only one face or a shape that covers three faces.

It should further be noted that, additional components including, for example, the throttle position sensor detecting rotation angle of the throttle shaft 48 (i.e., opening of the throttle valve 46) may be housed in the case 52.

Japanese Patent Application No. 2004-282371 filed on Sep. 28, 2004, is incorporated herein in its entirety.

While the invention has thus been shown and described with reference to specific embodiments, it should be noted that the invention is in no way limited to the details of the described arrangements; changes and modifications may be made without departing from the scope of the appended claims.

What is claimed is:

1. A throttle device for a multipurpose engine, comprising:

a throttle body disposed at an intake pipe of the engine and housing a throttle valve that regulates air drawn in the intake pipe; and a case integrally attached to the throttle body and housing an electric motor moving the throttle valve, a speed reducer connecting an output shaft of the motor with a throttle shaft of the throttle valve, an electronic circuit board having an electronic control unit that controls operation of the motor and a connector mounted thereon, and a harness connecting the motor with the connector, wherein the case is configured in an L-like shape to form a first space in which the speed reducer is installed and a second space in which the electronic circuit board is installed.

2. The throttle device according to claim 1, wherein the motor is installed at a region where the two spaces meet at right angles to be situated at an intermediate location between the speed reducer and the electronic circuit board.

3. The throttle device according to claim 1, wherein the case is imparted with waterproofing and dustproofing capability.

* * * * *